United States Patent [19]

Thaler et al.

[11] Patent Number: 4,791,272

[45] Date of Patent: Dec. 13, 1988

[54] PTC HAIR ROLLER

[75] Inventors: Arnold Thaler, Plantation, Fla.; P. C. Yip, Tsuenwan, Hong Kong

[73] Assignee: Windmere Corporation, Miami Lakes, Fla.

[21] Appl. No.: 922,945

[22] Filed: Oct. 24, 1986

[51] Int. Cl.[4] ..... A45D 2/36; H05B 3/00; H05B 1/02; H01C 7/02

[52] U.S. Cl. ..... 219/222; 132/226; 132/236; 219/242; 219/505; 219/540; 219/541; 338/22 R; 338/328

[58] Field of Search ..... 219/222–226, 219/242, 504, 505, 540, 541, 530, 544, 552; 338/22 R, 328; 132/33 R, 33 G, 11 R

[56] References Cited

U.S. PATENT DOCUMENTS

| | | | |
|---|---|---|---|
| 3,375,774 | 4/1968 | Fujimura et al. | 338/22 R X |
| 3,559,658 | 2/1971 | Gemest | 219/222 X |
| 3,617,694 | 11/1971 | D'Entremont | 219/222 |
| 3,617,695 | 11/1971 | D'Entremont | 219/222 |
| 3,632,971 | 1/1972 | Flanagan | 219/222 |
| 3,673,382 | 6/1972 | Gaffney et al. | 219/222 |
| 3,689,736 | 9/1972 | Meyer | 219/222 |
| 3,973,100 | 8/1976 | Flanagan | 219/222 |
| 4,045,763 | 8/1977 | Miyamoto et al. | 338/22 R |
| 4,147,927 | 4/1979 | Pirotte | 219/505 X |
| 4,284,877 | 8/1981 | Abura et al. | 219/222 |
| 4,341,949 | 7/1982 | Steimer et al. | 219/505 X |
| 4,447,705 | 5/1984 | Bullock | 219/222 |

FOREIGN PATENT DOCUMENTS

| | | | |
|---|---|---|---|
| 42527 | 12/1981 | European Pat. Off. | 219/505 |
| 53-89555 | 8/1978 | Japan . | |
| 53-89556 | 8/1978 | Japan . | |
| 54-36863 | 3/1979 | Japan . | |
| 54-36864 | 3/1979 | Japan . | |
| 54-36868 | 3/1979 | Japan . | |
| 54-36871 | 3/1979 | Japan . | |

*Primary Examiner*—Anthony Bartis

*Attorney, Agent, or Firm*—Dickstein, Shapiro & Morin

[57] ABSTRACT

A heat generating curling implement includes a generally cylindrical body member about which hair may be wound and containing two heat radiating U-shaped plates with interlinking base portions with a positive temperature coefficient heating element sandwiched between the inside surfaces of the interlinked base portions. Each plate has two heat radiating legs. All legs extend substantially in the same direction. The legs of both plates partially co-extend. The interlinking base portions do not contact one another. An electrode pin is in electrical contact through a contact plate to one of the radiating U-shaped plates. The electrode pin does not extend through the PTC element and does not extend through the base portion of the radiating plate. An electrode ring surrounds the electrode pin and is electrically insulated therefrom and electrically connected to the other radiating U-shaped plates through a second contact plate.

14 Claims, 3 Drawing Sheets

PTC HAIR ROLLER

BACKGROUND OF THE INVENTION

This invention relates to electrically heated hair curlers and rollers containing as a self regulating heater a positive temperature coefficient thermistor (PTC) material which heats the curler or roller body quickly and maintains the temperature of the roller substantially constant during heating, and to the heater structure in said roller.

Abura et al, U.S. Pat. No. 4,284,877, and Bullock, U.S. Pat. No. 4,447,705, each relate to hair curling rollers having positive temperature coefficient thermistors (PTC) electric heating elements. In Abura et al the hair curler includes a PTC heating element having a temperature self controlling function housed within a substantially hollow hair bobbin. A pair of opposed cup-shaped generally cylindrical members are housed within the bobbin with each cylindrical member including a bottom and a side wall. The PTC heating element is held between the opposed bottoms of the cup-shaped members. A powder supply pin extends through the heating element and both of the bottoms of the cup-shaped members for fastening the heating element and the electrode plates together.

In Bullock the construction is somewhat similar except the bottoms of the cups are held to the PTC heating element not by the power supply pin extending through the heating element but rather, by a number of rivet type connectors extending between the bottoms at the periphery of the PTC heating element. The construction according to the teaching of Bullock requires recesses to be formed in the PTC element and requires the use of many parts thus complicating assembly.

SUMMARY OF THE INVENTION

It is an object of the present invention to provide a heat generating hair curling implement.

It is further object of the present invention to provide a heat generating hair roller employing a positive temperature coefficient (PTC) heating element.

It is yet another object of the present invention to provide a hair roller having the foregoing advantages which is simple to construct.

These and other objects of the invention may be achieved by a hair roller construction including two elongated U-shaped heat radiating plates each having two radiating legs with interlinking base portions with a positive temperature coefficient ("PTC") thermistor element sandwiched between the interlinking surfaces of the base portions. The legs of both plates extend in the same direction and the interlinking base portions are electrically insulated from one another. Electrical contact means connect the first and second sides of the PTC with a source of electrical energy.

Other objects and advantages of the present invention will be readily apparent from the following description and drawings which illustrates a preferred embodiment of the present invention.

DESCRIPTION OF A PREFERRED EMBODIMENT

Figure 1:
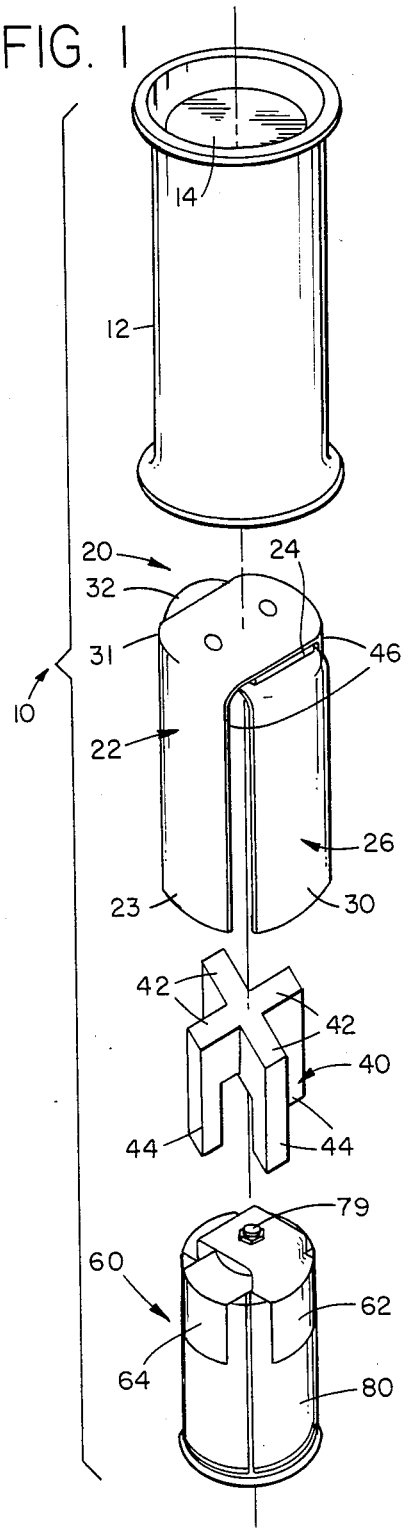
FIG. 1 is an exploded perspective view of a hair roller according to a preferred embodiment of the present invention.

Referring now to FIG. 1 there is shown an exploded perspective view of a hair curling roller generally designated by reference numeral 10 according to a preferred embodiment of the present invention.

Roller 10 has a generally cylindrical hollow outer case 12 around which hair is wound and which is enclosed at one end by an end wall 14. Outer case 12 and end wall 14 are composed of a material that is electrically insulating.

A heating assembly means 20 is positioned within the outer case 12. Heating assembly means 20 includes first radiating plate 22 and second radiating plate 26. Plates 22 and 26 are U-shaped and are generally composed of a material that conducts electricity and heat. Plate 22 has a base portion 31 and legs 23 and 25. Plate 26 has a base portion 32 and legs 29 and 30. Legs 23 and 25 and legs 30 and 33 are curved to conform to inside of case 12 and extend in a common direction substantially over the interior surface of case 12 except where they are separated for insulation purposes by ridges 87. Plate 26 is nestled within plate 22 so that legs 23 and 25 are 90° apart from legs 29 and 29. Base portions 31 and 32 are separated by electrically insulating end spacer 24.

A retainer 40 is composed of electrical insulating material and is disposed within heating assembly 20. Retainer 40 is cross-shaped and has four retainer arms 42 which form the base of the cross and four retainer legs 44 which extend away from and correspond to arms 42.

A contact assembly means 60 includes an end cap 80, and contact plates 62 and 64 disposed thereon. Contact plates 62 and 64 are U-shaped and composed of a material that conducts electricity. Contact plate 62 is connected to contact subassembly 70 by securing nut 79 to threaded end 73. The upper side of contact plate 64 is in engagement with subassembly 70 and the lower side is in engagement with end cap 80. End cap 80 is cylindrical and hollow and is composed of a material that is electrically insulating.

In the assembled roller the arms 42 of retainer 40 are in contact with plates 26 and 22 and the legs 44 of retainer 40 are in contact with contact plate 62 and 64. Retainer 40 keeps contact plates 62 and 64 positioned on end cap 80.

Figure 2:
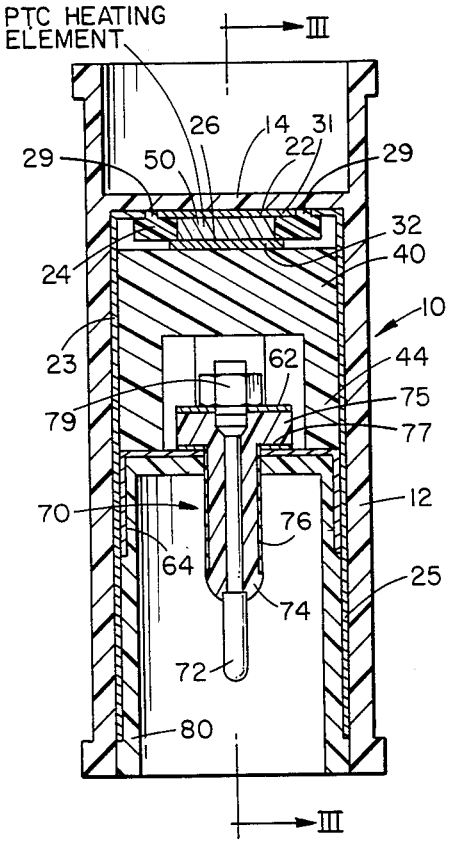
FIG. 2 is a cross-sectional elevational view of the hair roller of FIG. 1.
Figure 3:
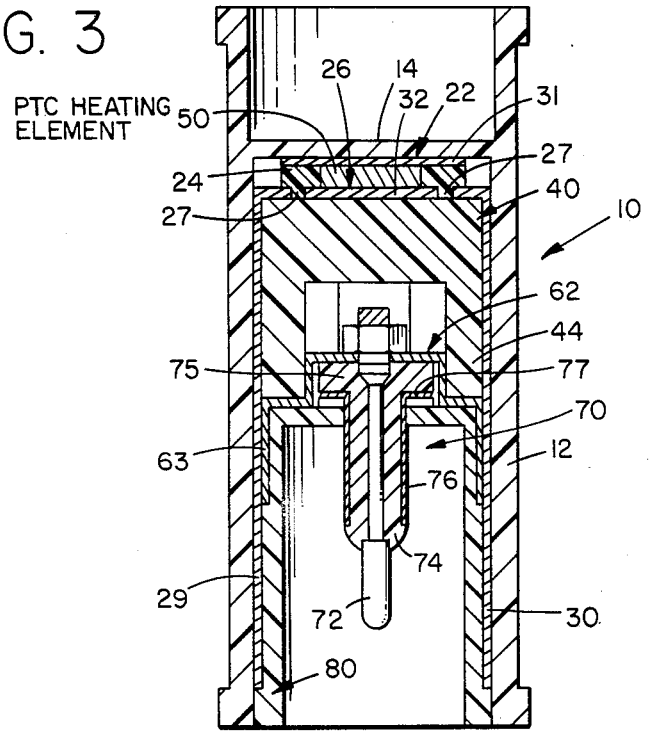
FIG. 3 is a view taken along section line III—III of FIG. 2.

Refer now to FIGS. 2 and 3 which are cross-sectional views of the hair roller 10. The view of FIG. 3 is rotated 90° from the view of FIG. 2. A positive temperature coefficient thermistor (PTC element) 50 is disposed between the base portions 31 and 33 of plates 22 and 26. An electrode pin 72 is in electrical contact with contact plate 62 and extends axially into end cap 80. Electrode pin 72 is surrounded partially by insulation 74. Contact ring 76 surrounds electrode pin 72 and is insulated from electrode pin 72 by the insulation 74. Contact ring 76 also has a flange portion 77 which is in electrical contact with contact plate 64. Part 75 is a flange of insulation material the bottom surface of which is in engagement with the upper surface of flange 77 and the top portion of which is in engagement with the lower surface of base portion 62.

Figure 4:
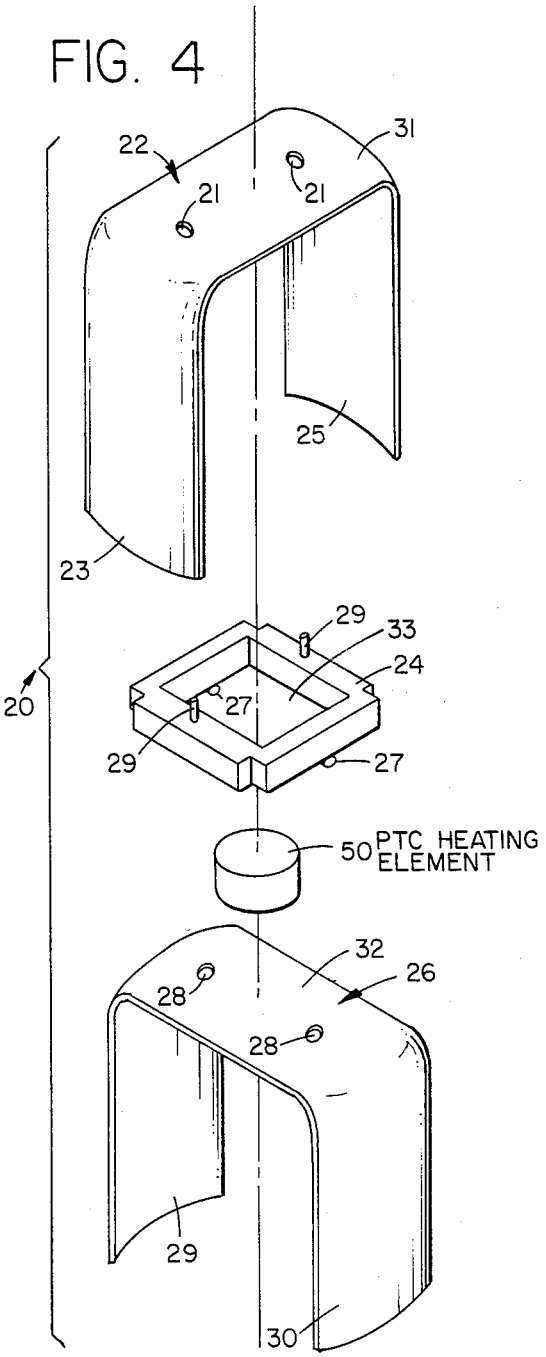
FIG. 4 is an exploded perspective view of the heating assembly of the hair roller of FIG. 1.

Referring to FIG. 4 there is depicted an exploded perspective view of heating assembly 20. Base portion 31 has two apertures 21 disposed therein. Base portion 32 has two apertures 28 disposed therein.

In a preferred embodiment spacer 24 is rectangular in shape with a rectangular aperture 33 therein and is composed of an electrical insulating material. Spacer 24 and aperture 33 may be any suitable shape such as oval, round or square. A PTC element 50 is disposed to be placed within the aperture of spacer 24. PTC element 50 may take any shape such as a disk, cube etc. as long as it is capable of placement in spacer 24 securely. Spacer 24 also has locating pins generally designated as 29 which are adapted to be placed within the apertures 21 of plate 22. Spacer 24 also has locating pins 27 adapted to be placed within apertures 28 of plate 26. PTC element 50 is characterized in that the resistance thereof is relatively low below a switching temperature, and increases rapidly above the switching temperature. Because of these characteristics, when the PTC element 50 is supplied with a given voltage, the temperature thereof will rise rapidly by the initially large power consumption but does not exceed a certain temperature due to a drop in power consumption resulting from an increase of the resistance with the rise in temperature, whereby a constant temperature is maintained and thus a temperature control of the PTC element 50 itself. In this manner, therefore it is possible for PTC element 50 to bring outer case 12, through thermal contact with the base portions of plates 22 and 26 to an appropriate temperature promptly and to maintain said temperature.

Figure 5:
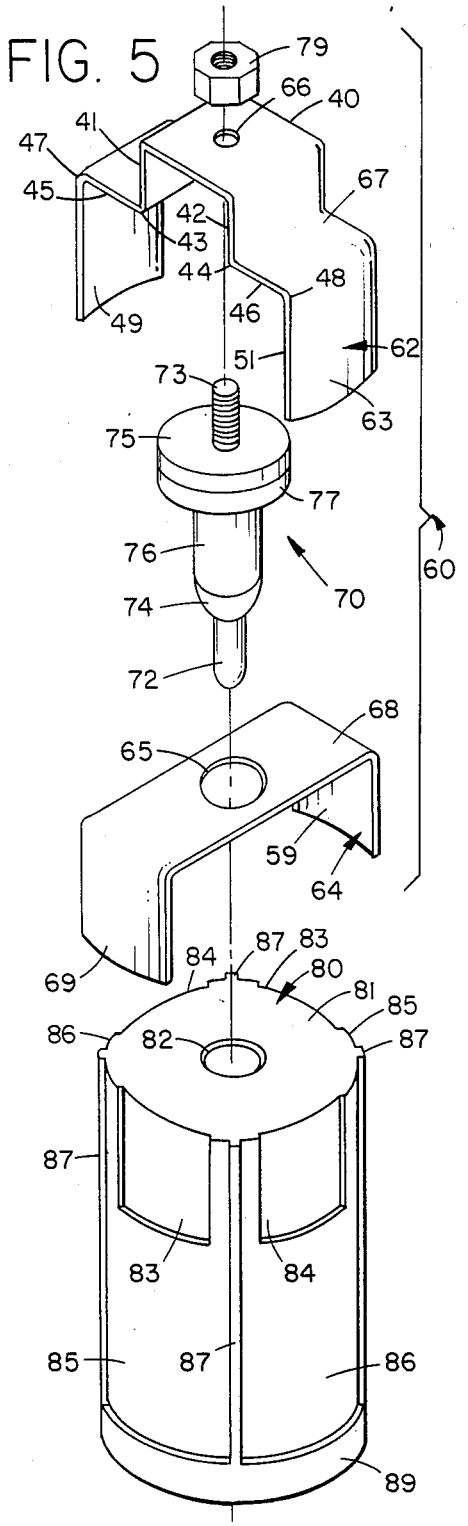
FIG. 5 is an exploded perspective view of the contact assembly of the hair roller of FIG. 1.

Referring now to FIG. 5 there is shown an exploded perspective view of the contact assembly 60 of the hair roller. Contact plate 62 is a folded plate having a base 40, first and second legs 41 and 42 with bottoms 43 and 44 respectively, first and second branches 45 and 46 with outer ends 47 and 48 respectively, and first and second arms 49 and 51. First and second legs 41 and 42 extend vertically down from base 40 and are parallel to one another. First and second branches 45 and 46 extend horizontally away from the bottoms 43 and 44 of first and second legs 41 and 42 in a horizontal direction. First and second arms 49 and 51 extend vertically downwardly from the outward ends 47 and 48 of branches 45 and 46 and are parallel to one another. The base 40 has an aperture 66 disposed therein.

Contact plate 64 is U-shaped and has a base portion 68 and first and second legs 59 and 69 respectively. A circular aperture 65 is disposed within the base portion 68 of contact plate 64.

Contact subassembly 70 includes an electrode pin 72 having a threaded end 73 which conducts electricity, and a contact ring 76 disposed around electrode pin 72 including a flange portion 77. Insulator 74 is disposed between contact ring 76 and pin 72 and has a flange 75 abutting flange 77 of contact ring 76. The threaded end 73 of contact pin 72 extends through aperture 66 of base portion 40. Nut 79 secures contact plate 62 to contact subassembly 70.

End cap 80 includes a base portion 81 with a circular aperture 82 disposed therein and a barrel 89. Aperture 82 is adapted to receive contact ring 76 and contact pin 72 but is not large enough to receive flange 75. Barrel 89 has first and second rectangular recesses 85 and 86 respectively therein. Recesses 85 are adapted to receive the legs 23 and 25 of plate 22 or legs 30 and 33 of plate 26 and each recess 85 has a rectangular recess 83 disposed therein. Recesses 86 are adapted to receive the legs 23 and 25 of plate 22 or legs 29 and 30 of plate 26 and each recess 86 has a rectangular recess 84 disposed therein. Recess 83 and 84 are adapted for placement of the legs of contact plate 64 and 63 therein. Ridge 87 is disposed between recesses 85 and 86 thereby separating legs 23 and 25 of plate 22 from legs 29 and 30 of plate 26. Pins 27 and 29 and ridge 87 prevent rotation of plates 22 and 26 and electrically insulate plate 22 from plate 26 and align and hold in conjunction with the outer case 12, spacers 40 and 24, end cap 80 and the plates in position. The assembly may then be molded into outer case 12 of roller 10 which holds parts 20, 60 and 70 in assembled relationship.

To assembly the rollers, contact plate 64 is placed on end cap 80 so that the legs 69 and 59 are disposed in recesses 83 or 84. Contact pin 72 and contact ring 76 are placed in aperture 82 so that the bottom surface of flange is in engagement with base portion 68. Contact plate 62 is positioned so that aperture 66 receives threaded end 73 of contact pin 72 and the bottom surface of base portion 67 is in engagement with the top surface of flange 75. Nut 79 is positioned on threaded end 73. Retainer 40 is positioned so that legs 44 contact contact plate 62 and 64. The heating assembly is positioned so that arms 42 of retainer 40 contact legs 23, 25, 30 and 32 respectively. Outer case 12 is placed so that heating assembly 20 is disposed therein and base portion 31 in engagement with end wall 14.

Figure 6:
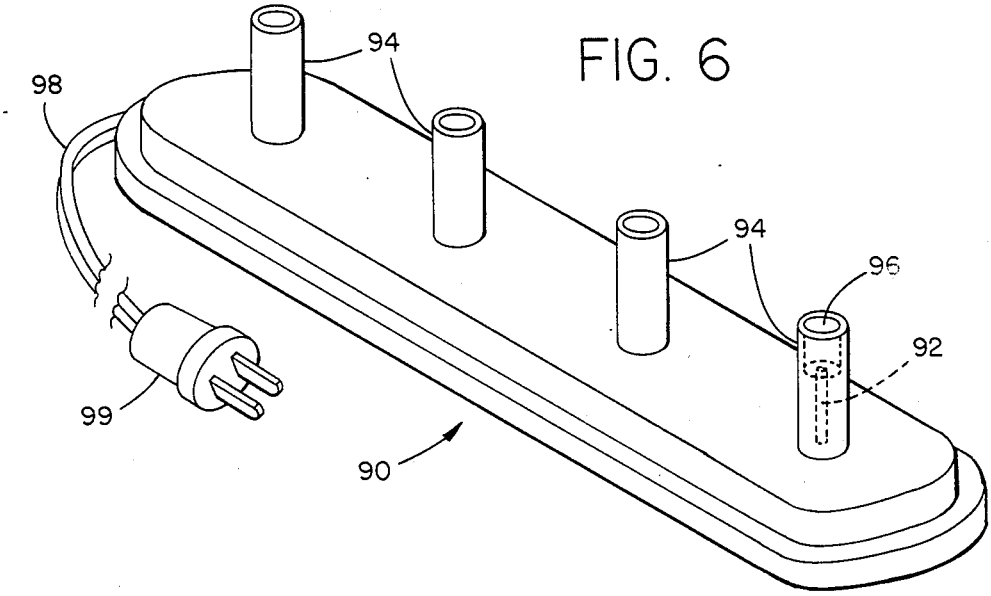
FIG. 6 is a perspective view showing the hair roller of FIG. 1 on a heating device.

There is provided a heating device 90 as depicted in FIG. 6 to supply electric power to hair curler 10. Heating device 90 is composed of insulating material and provided with socket 92. Socket 92 consists of a projection member 94 on which hair curler 10 is placed. Socket 92 has an opening 96 adapted to receive pin 72 therein. Plug 99 is placed in an outlet supplying alternating curent and said current passes through cord 98 to socket 92. Socket 92 supplies electricity to pin 72 when roller 10 is placed on heating device 90. The electricity passes through pin 72 to contact plate 62. Electricity then passes to plate 26 through PTC element 50 to plate 22. The electricity then passes through plate 22 to contact plate 64 to contact ring 76 to the other electrode of socket 92 completing the circuit. Heating device 90 may have a plurality of sockets such as 92 to heat a plurality of rollers such as 10.

The above description and drawings are only illustrative of one embodiment which achieves the objects its features and advantages of the present invention and it is not intended that the present invention be limited thereto. Any modifications of the present invention which come within the spirit and scope of the following claims are considered part of the present invention.

What is claimed is:

1. A heat generating hair curling implement comprising:

a generally hollow cylindrical body member about which hair may be wound;

a positive temperature coefficient heating element having a first side and a second side;

a first U-shaped heat radiating plate composed of an electricaly and thermally conductive material having two heat radiating legs and a base portion;

a second U-shaped heat radiating plate composed of an electrically and thermally conductive material having two heat radiating legs and a base portion, said base portions being linked together with said heating element positioned between said base portions and in electrical and heat conducting relationship therewith;

the heat radiating plates being, with said heating element so positioned, disposed within the cylindrical body member so that the heat radiating legs of both plates extend away from their respective base portions in the same direction;

electrical contact means in said body member in electrical contact with said first and second heat radiating plates for connecting said first and second sides of said heating element with a source of electrical energy; and means to hold said first and second plates within said cylindrical body member.

2. A heat generating hair curling implement as in claim 1 wherein the base portion of the first plate is nestled within the base portion of the second plate with the heating element therebetween and the legs of the first plate are positioned at approximately 90° from the legs of the second plate.

3. A heat generating hair curling implement as in claim 2 wherein the contact means includes:

a U-shaped contact plate with a base and two legs and a folded contact plate with a base and two arms, said contact plates being positioned so that the U-shaped contact plate is nestled within but out of contact with the folded contact plate and the legs of the U-shaped contact plate and the arms of the folded plate extend away from their respective bases in a common direction but being located approximately 90° from one another, said legs of the U-shaped contact plate being in electrical contact with the legs of the first radiating plate and the arms of the folded contact plate being in electrical contact with the legs of the second radiating plate;

a contact pin with a threaded portion on one end extending from and in electrical contact with the base of the folded contact plate; and an electrical contact ring positioned generally concentrically about and electrically insulated from said pin, said contact ring being in electrical contact with the base portion of the U-shaped contact plate.

4. A heat generating hair curling implement as in claim 3 wherein the folded contact plate comprises:

said base;

first and second legs each with bottoms extending vertically downward from the base, the legs being parallel to one another;

first and second branches each with an outward end extending horizontally away from the bottoms of first and second legs respectively; and said two arms comprise first and second arms extending vertically downward from the outward ends of the first and second branches respectively, said arms being parallel to one another.

5. A heat generating hair curling implement as in claim 4 further including an end cap on said body, said end cap having first and second recesses therein disposed to receive the legs of the first and second radiating plates, said first and second recesses further having third and fourth recesses disposed to receive the legs of the U-shaped contact plate and the first and second arms of the folded contact plate.

6. A heat generating hair curling implement as in claim 5 wherein the contact ring has a flange portion in electric contact with the base of the V-shaped contact plate.

7. A heat generating hair curling implement as in claim 6 wherein a nut is disposed on the threaded portion of the contact pin to secure the base of said folded contact plate to the contact pin.

8. A heat generating hair curling implement as in claim 7 wherein a cross shaped retainer is disposed within the cylindrical body to hold the first and second heat radiating plates therein.

9. A heat generating hair curling implement as in claim 8 further comprising a detachable power supply means including a socket with a projection member adapted for insertion into said body member, said projection member having an aperture adapted to receive the contact pin therein, said socket being connected to a source of electricity at one end and the contact pin at the other end thereby supplying electricity thereto.

10. An electrically heated hair curler comprising a generally cylindrical outercase, a PTC heating element with a first and second side mounted within the case in heat transfer relation to the outercase; means for providing electrical power to the heating element and for transferring heat from the heating element to the outercase, wherein said electrical connection and heat transferring means includes first and second electrically conductive U-shaped plates within said case, said plates each having a base portion and heat radiating legs, all of said legs extending substantially in the same direction and the legs of said first plate at least partially coextending with the legs of said second plate, said base portions being positioned to link the respective heat radiating legs of the first and second electrically conductive plates together with said heating element positioned therebetween in electrical and heat conducting engagement to said base portions.

11. A hair curler as in claim 10 wherein the base portion of each U-shaped plate has at least one aperture and said curler further comprises:

an electrically insulating spacer having an aperture therein and a top with at least one locating pin and a bottom with at least one locating pin, said spacer is disposed to hold the PTC heaing element within said aperture and is positioned so that the top of the spacer is in contact with the base portion of the first U-shaped plate and the bottom of the spacer is in contact with the base portion of the second U-shaped plate and said sapcer is secured by the placement of at least one locating pin in at least one aperture of said first base portion of said U-shaped plate and the placement of at least one locating pin in at least one aperture of said base portion of the second U-shaped plate thereby providing electrical contact between the first side of said PTC element and the base of the first U-shaped plate and between the second side of said PTC element and the base of the second U-shaped plate.

12. An electric hair curler comprising:

a cylindrical hollow housing;

a PTC heating element;

first and second U-shaped members each having two legs and a base portion and composed of a material that conducts heat and electricity and each disposed inside the cylindrical hollow housing, said base portions positioned in linking relationship through the use of an end spacer having locating pins corresponding to apertures in the base portions such that the legs of the first U-shaped member and the legs of the second U-shaped member are in heat exchange relationship with the housing and extend in the same direction from their respective base portions substantially in a common direction and the heating element is sandwiched between said base portions in electrical and heat conducting relationship thereto;

means on said housing electrically connected to the U-shaped members to supply electricity to the heating element.

13. A method of assembling a heating assembly comprising the steps of:

providing two U-shaped heat radiating plates, each said plate having a base portion, two heat radiating legs and two apertures disposed through the base portion, arranging said U-shaped plates such that all of said legs extend substantially in the same direction with the legs of said first plate at least partially coextending with the legs of said second plate; and linking the U-shaped plates with a heating element positioned therebetween with said heating element positioned in heat conducting relationship to said base portions thereof.

14. A method of assembling a contact assembly comprising the steps of:

providing a U-shaped contact plate and a folded contact plate each having an aperture therein and two legs; arranging said contact plates such that all of said legs extend substantially in the same direction with the legs of said first plate at least partially coextending with the legs of said second plate;

linking the contact plates such that the contact plates are electrically insulated from each other;

electrically attaching an electrode pin to the first contact plate so that the pin extends along the length of the legs of the first contact plate; and electrically attaching a contact ring to the second contact plate so that the contact ring extends along the length of the legs of the second contact plate and said ring surrounds said pin and is electrically insulated therefrom.

* * * * *